US010758445B2

(12) United States Patent
Fiore

(10) Patent No.: US 10,758,445 B2
(45) Date of Patent: Sep. 1, 2020

(54) FLEXIBLE INSTRUMENT FOR SOFT TISSUE MOBILIZATION

(71) Applicant: Russell D. Fiore, Lincoln, RI (US)

(72) Inventor: Russell D. Fiore, Lincoln, RI (US)

( * ) Notice: Subject to any disclaimer, the term of this patent is extended or adjusted under 35 U.S.C. 154(b) by 1232 days.

(21) Appl. No.: 14/998,816

(22) Filed: Feb. 19, 2016

(65) Prior Publication Data

US 2018/0064600 A1 Mar. 8, 2018

(51) Int. Cl.
*A61H 7/00* (2006.01)

(52) U.S. Cl.
CPC ..... *A61H 7/003* (2013.01); *A61H 2201/0192* (2013.01); *A61H 2201/1692* (2013.01)

(58) Field of Classification Search
CPC ..... A61H 7/00; A61H 7/002; A61H 7/003; A61H 7/004; A61H 7/005; A61H 7/007; A61H 2201/169; A61H 2201/1692; A61H 2201/1695
USPC ..... D24/200, 215, 213, 214, 211
See application file for complete search history.

(56) References Cited

U.S. PATENT DOCUMENTS 799,895 A * 9/1905 Doughty et al. ..... A61H 7/003 601/137
998,328 A * 7/1911 Czinjak ..... A61H 23/06 601/107
1,817,585 A * 8/1931 Samuel ..... A46D 1/00 15/188
2,806,470 A * 9/1957 Ferrier ..... A61H 7/003 601/135
4,461,285 A * 7/1984 Courtin ..... A46B 9/02 15/110
4,590,926 A * 5/1986 Courtin ..... A61H 7/003 601/134
4,892,091 A * 1/1990 Sullenger ..... A47K 7/02 601/137
5,441,478 A * 8/1995 Graston ..... A61H 7/003 601/135
5,577,997 A * 11/1996 Thariani ..... A61B 17/54 601/135
5,707,346 A * 1/1998 Graston ..... A61H 7/003 601/135
6,077,239 A * 6/2000 Lin ..... A61H 7/003 601/134
6,241,694 B1 * 6/2001 Goulding-Thompson ..... A61H 7/001 601/134
8,801,642 B1 * 8/2014 Slominski ..... A61H 7/001 601/134
9,925,110 B1 * 3/2018 Lang ..... A61H 7/003
D827,848 S * 9/2018 Iwagami ..... D24/215
10,434,032 B2 * 10/2019 Ghosh ..... A61H 7/001
2005/0033206 A1 * 2/2005 Yeh ..... A47K 5/03 601/158
2005/0049534 A1 * 3/2005 Wang ..... A61H 7/003 601/135
2005/0165450 A1 * 7/2005 Perez-Torrens ..... A61H 1/0292 606/240
2006/0247563 A1 * 11/2006 Martin ..... A61H 7/001 601/135

(Continued)

*Primary Examiner* — Michael J Tsai
(74) *Attorney, Agent, or Firm* — Robert J. Doherty

(57) ABSTRACT

An instrument for massaging human body portions having multiple treatment edges and preferably including a plurality of upwardly extending treatment nubs which instrument is bendable into a variety of generally U-shaped configurations to better engage the body portions to be massaged.

9 Claims, 11 Drawing Sheets

(56) References Cited

U.S. PATENT DOCUMENTS

| | | | | |
|---|---|---|---|---|
| 2012/0158040 | A1* | 6/2012 | Dehors | A61H 7/003 606/201 |
| 2013/0296750 | A1* | 11/2013 | Pursel | A61H 99/00 601/137 |
| 2014/0005581 | A1* | 1/2014 | Scappaticci | A61H 7/003 601/138 |
| 2014/0213944 | A1* | 7/2014 | Kojima | A61H 39/04 601/137 |
| 2015/0150749 | A1* | 6/2015 | Deramo | A61H 7/007 601/135 |
| 2016/0287466 | A1* | 10/2016 | Bampton | A61H 7/003 |
| 2017/0340509 | A1* | 11/2017 | van den Dries | A61H 7/003 |

* cited by examiner

FLEXIBLE INSTRUMENT FOR SOFT TISSUE MOBILIZATION

This application is an improvement and modification of applicant's pending U.S. patent application Ser. No. 13/999,728 filed Mar. 18, 2014 which, in turn, claims the benefit of U.S. Provisional Patent Application No. 61/852,958 filed Mar. 25, 2013. Accordingly, the present application incorporates the disclosures of the foregoing utility U.S. patent application Ser. No. 13/999,728 and U.S. Provisional Patent Application No. 61/852,958 by specific reference thereto.

BACKGROUND OF THE INVENTION

This invention deals with the massage and mobilization of the soft body tissue of the bodies of human and similar species. The invention has special use in the treatment of soft tissue injuries common with athletic activity although not limited thereto. When the soft body tissue of a human is subjected to trauma, overuse, etc., the connective tissue (fascia) underlying the skin may be affected, and this and other reasons can cause inelastic fibrous adhesions between the layers of the myofascial system that prevent normal muscle mechanics and decrease soft tissue extensibility and can lead to further injury. Historically, the treatment of such aforementioned conditions is by hand manipulation and massage of the affected soft tissue area by a clinician such as an athletic trainer, etc. by either using his/her hands or manipulating various rigid tools or instruments having fixed straight edges or curvatures shaped to conform to different parts of the body. Such tools can increase the mechanical advantage for the clinician and can reduce the stress on the clinician's hands—however, this approach requires the purchase of variously sized instruments to conform to the different areas of the body as well as bodies of various sizes.

Many different hand held instruments are available for use to assist with soft tissue mobilization. These instruments are available in different shapes and sizes and are constructed from different materials including plastic, bone, ceramic and stainless steel. When using an instrument, the clinician must choose an instrument with a shape that is compatible to the area being treated. If the forearm, which is convex, were being treated, a concave instrument could be used that matches the shape of the forearm. This would result in uniform pressure over the soft tissue. If a flat or convex instrument were used to treat the forearm, less tissue area would be treated with each stroke of the instrument; and if the clinician used the same pressure as with the concave instrument, a greater overall pressure would be put on the tissue being treated. A concave instrument with a curve that is greater than that of the forearm would result in pressure only on the central area of the forearm without full or at least substantial contact and should not be used.

Accordingly, it would be desirable to have a single instrument that provides the advantages of a device that would provide the desired mechanical advantage for the clinician to reduce the strain on the clinician's hands common in hand manipulation yet provides the possibility of a large number of shaped surfaces for engaging the differently shaped areas of the patient's body. A further desirable feature would be the provision of openings in the instrument to enable the ergonomically grasping of the instrument. A still further desirable feature would be the provision of such a single instrument which is of simple, relatively low cost construction and which does not require a dedicated inventory and carrying kit.

A further desirable feature of a mobilization instrument would be the provision of a series of nubs that protrude from the surface of the instrument such that a deeper penetration of the upper layers of the skin or epidermis is achieved through the, in effect, grasping action of the nubs. In this way, the nubs enable deeper movement of the skin layers as the instrument moves through a series of therapeutic movements so as to more quickly break up adhesions, etc. The nubs may be of various heights and spacing's, however, it has been found advantageous to group same or similar height nubs together.

These and other objects of the invention are accomplished by the provision of a massage instrument adapted to be held by a user comprising a generally rectangular body having opposed generally flat front and rear surfaces and peripheral top, bottom and side connecting edges, said edges having varying configurations from relatively sharp to relatively rounded so as to present a variety of treatment edges for the mobilization and massage of the soft tissue of the human body when the user angularly engages one of said treatment edges with a soft tissue area of the human body.

In addition, further objects of the invention are accomplished by the provision of a massage instrument adapted to be held by a user comprising a generally flat body having opposed generally flat front and rear surfaces, said body further including peripheral top, bottom and side edges, said body including a plurality of tissue engaging nubs outwardly extending from at least one of said front and rear surfaces, said nubs arranged in one or more patterns that extend around the periphery of said body and positioned laterally inwardly from said top and bottom edges thereof and longitudinally inwardly from said side edges thereof, said nubs presenting a variety of treatment surfaces for the mobilization and massage of the soft tissue of the human body when the user presses said body and thus said nubs into the soft tissue being manipulated or massaged.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
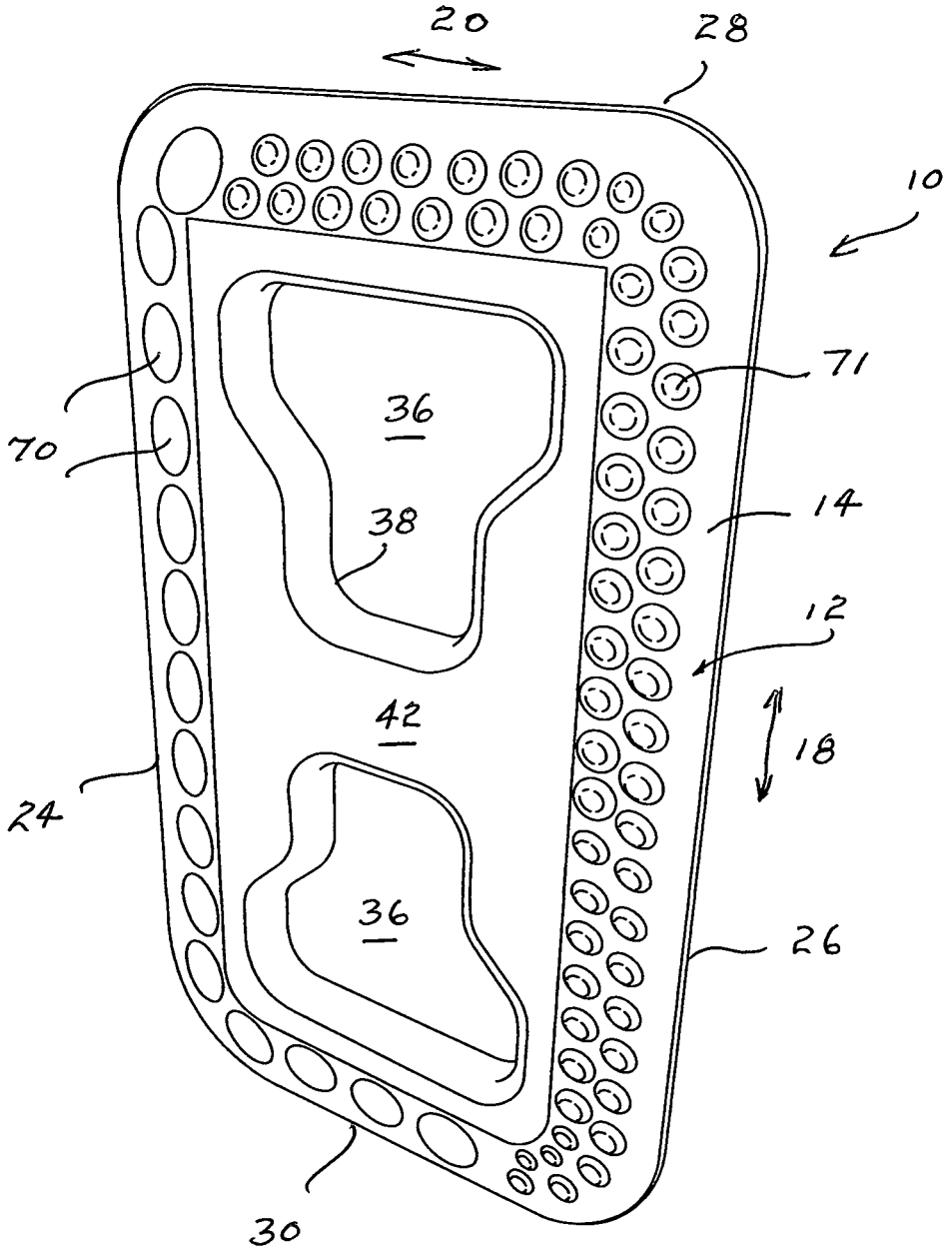
FIG. 1 is a front perspective view of one form of the instrument of the present invention.
Figure 2:
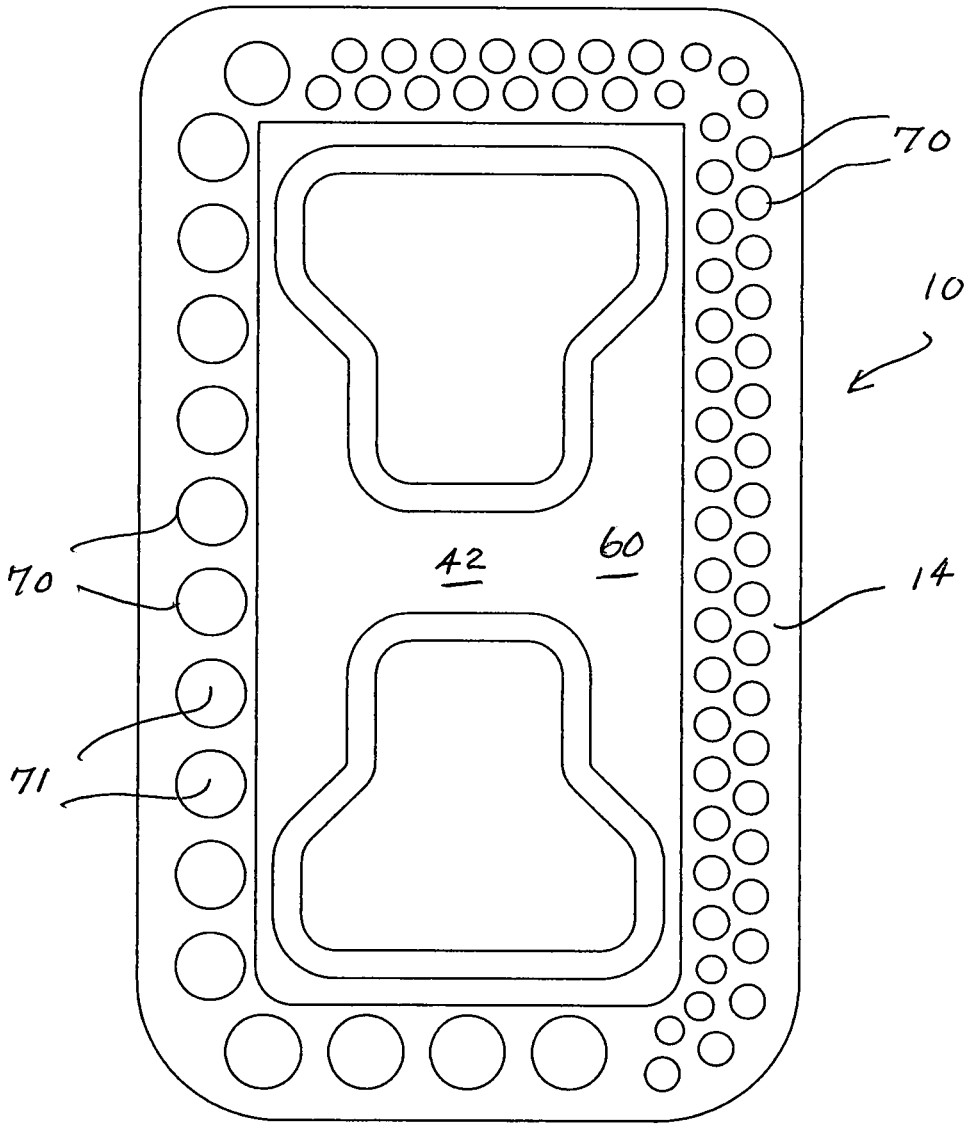
FIG. 2 is a front elevational view of FIG. 1.
Figure 3:
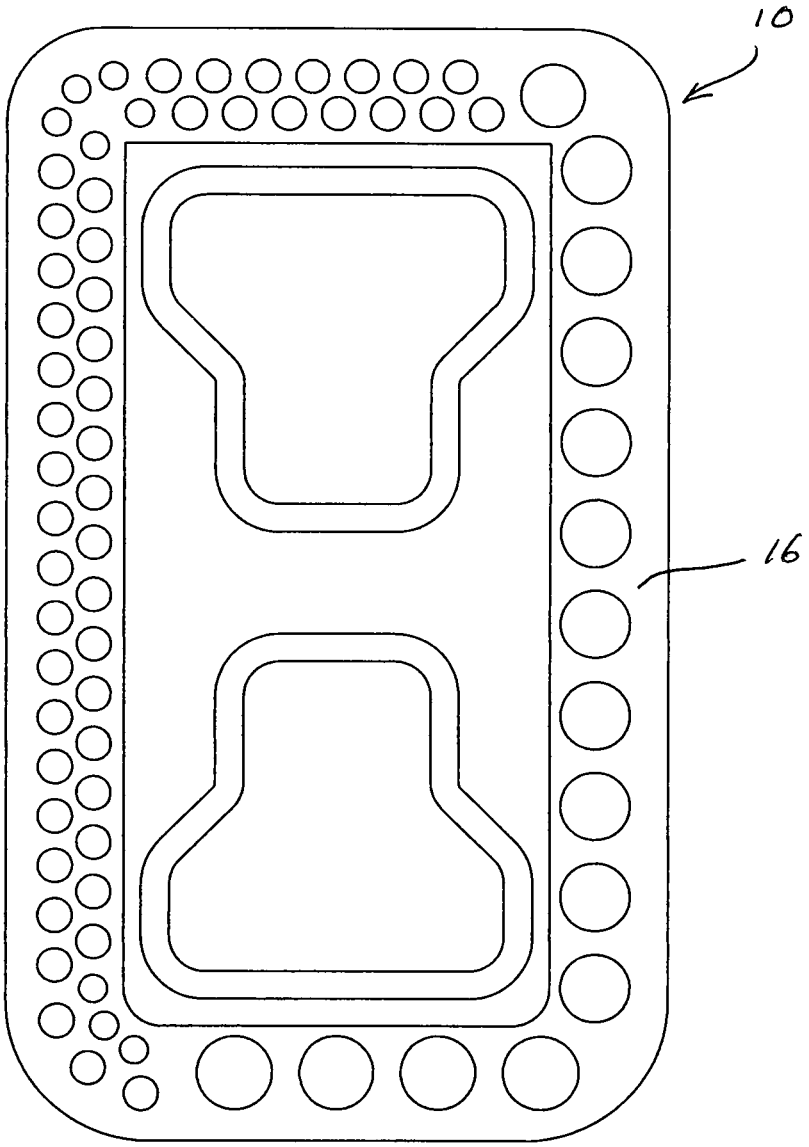
FIG. 3 is a rear elevational view of FIG. 1.
Figure 4:
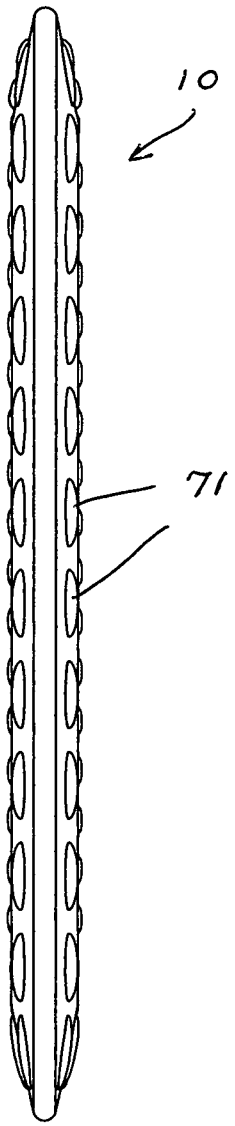
FIG. 4 is a left side elevational view of FIG. 2.
Figure 5:
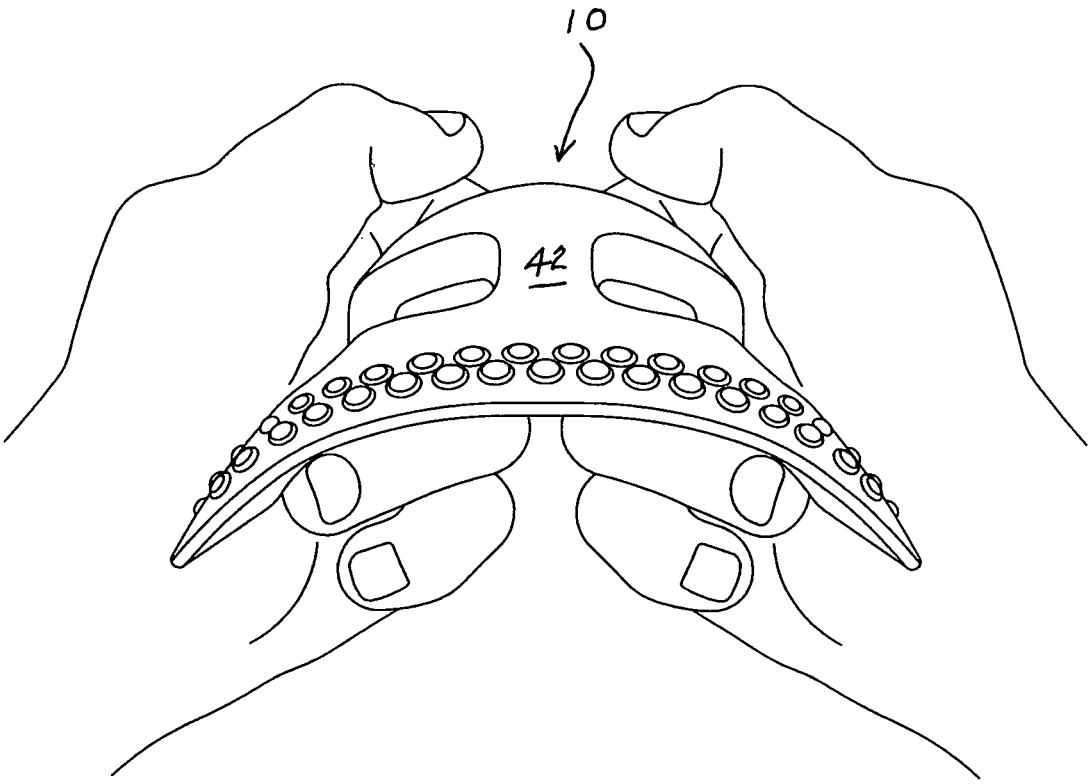
FIG. 5 is a perspective view of a clinician holding the instrument in a bent attitude to conform to the body profile of a patient preparatory to massaging.
Figure 6:
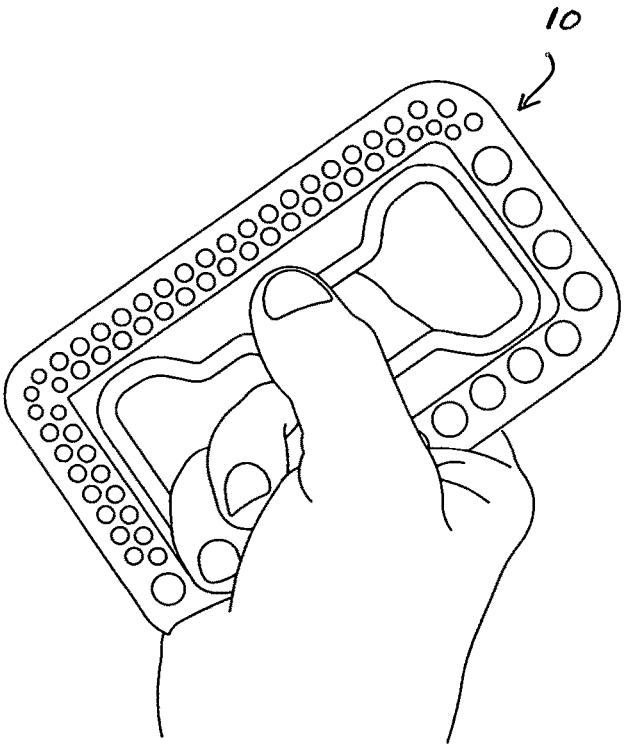
FIGS. 6 through 9 are perspective views illustrating several manners in which the instrument may be grasped by the user.
Figure 7:
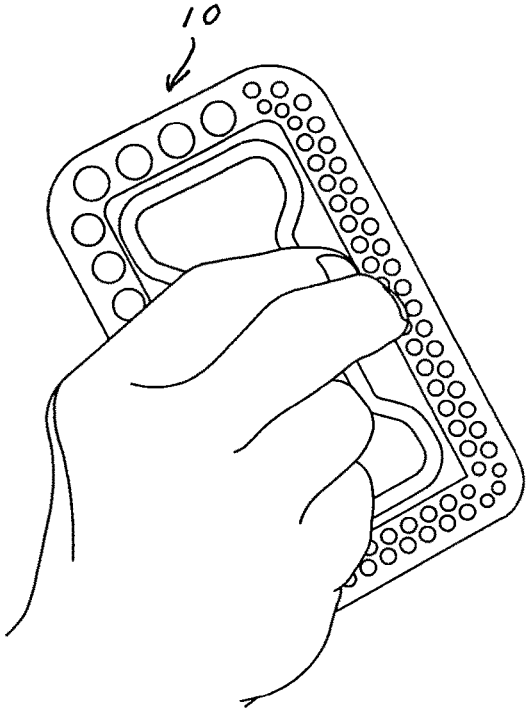
Figure 8:
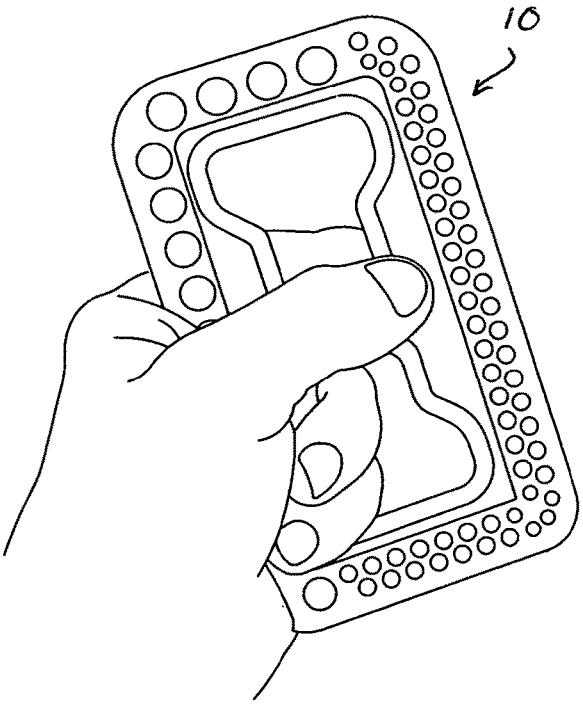
Figure 9:
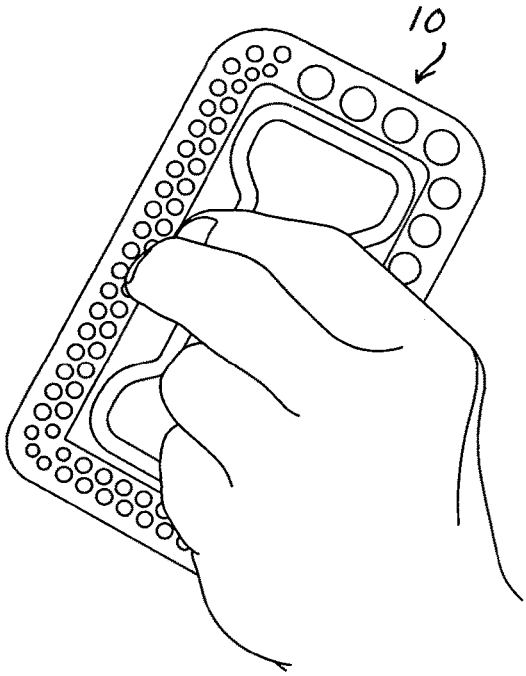
Figure 10:
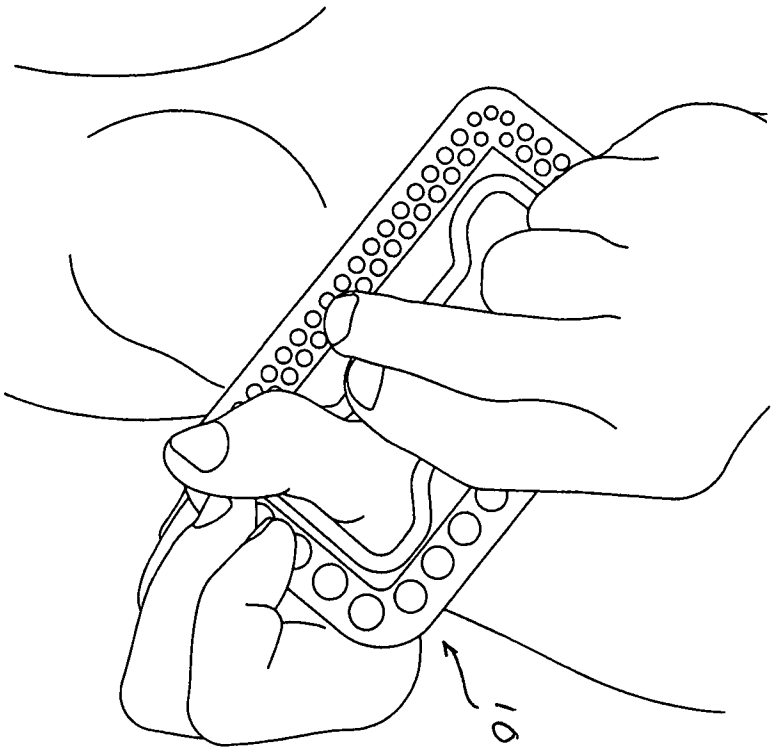
FIGS. 10 through 18 are perspective views illustrating various manners of use of the instrument in the massage of various body portions of a patient.
Figure 11:
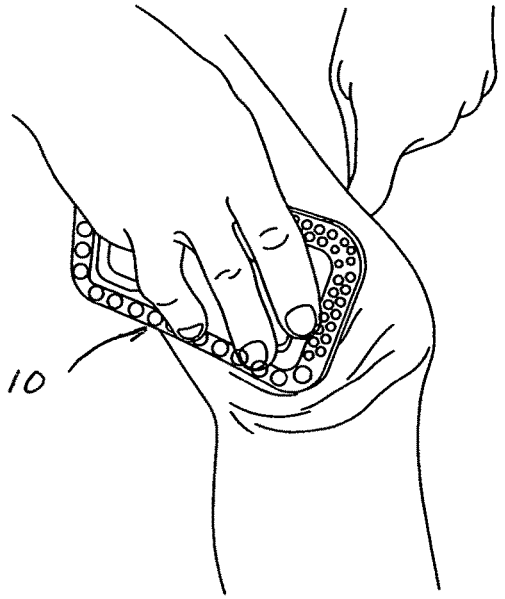
Figure 12:
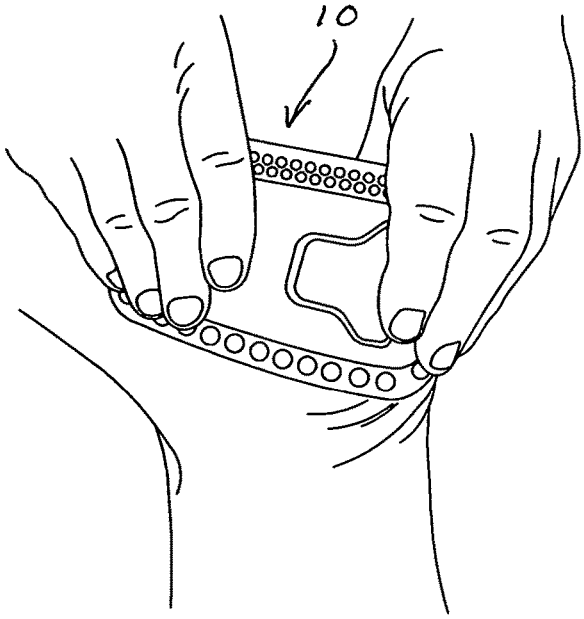
Figure 13:
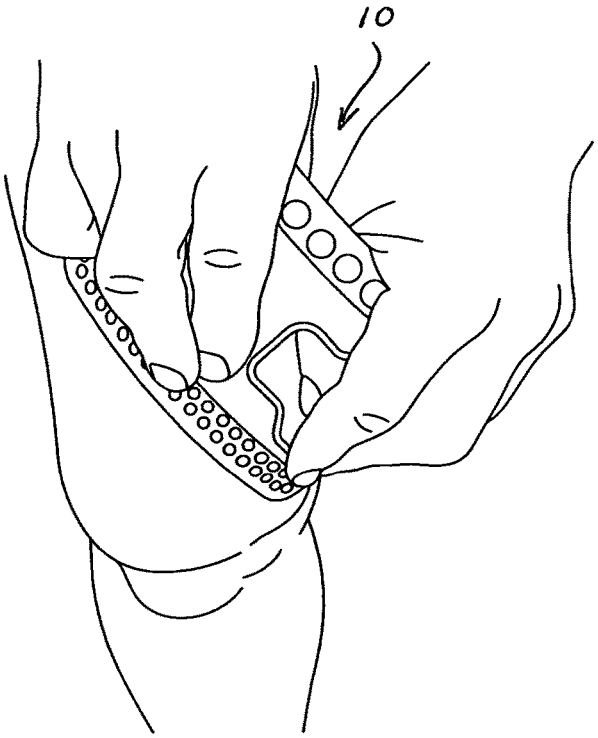
Figure 14:
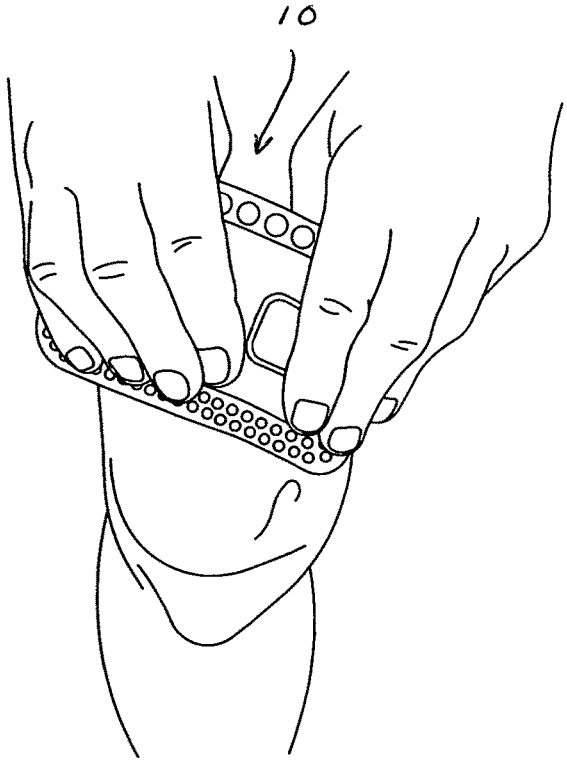
Figure 15:
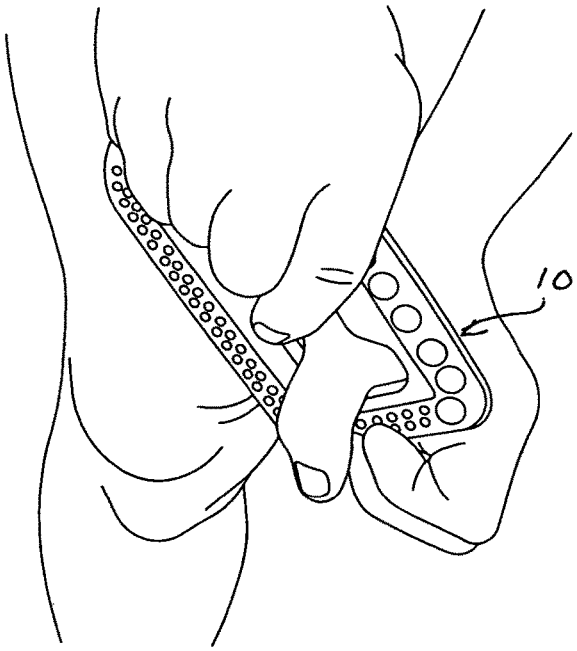
Figure 16:
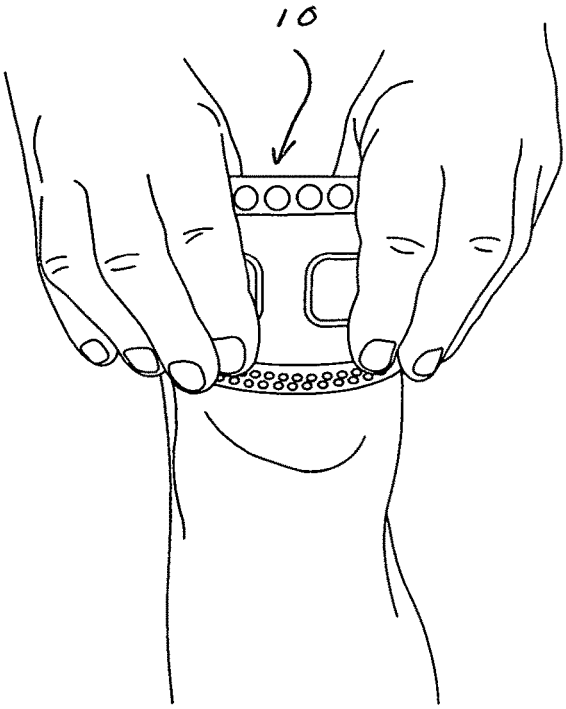
Figure 17:
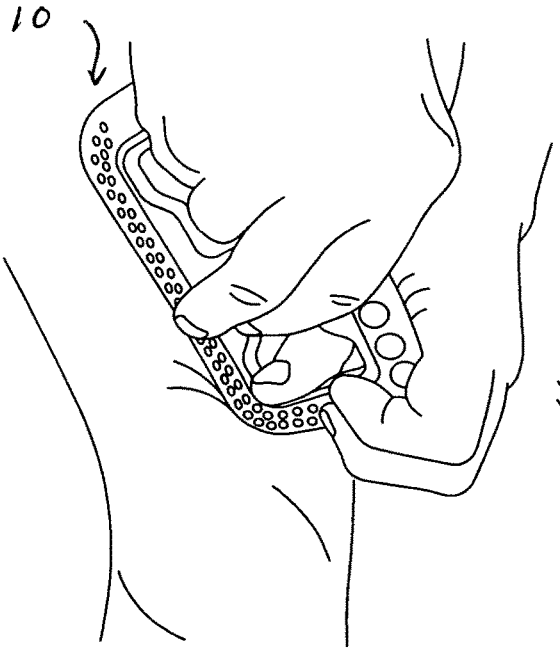
Figure 18:
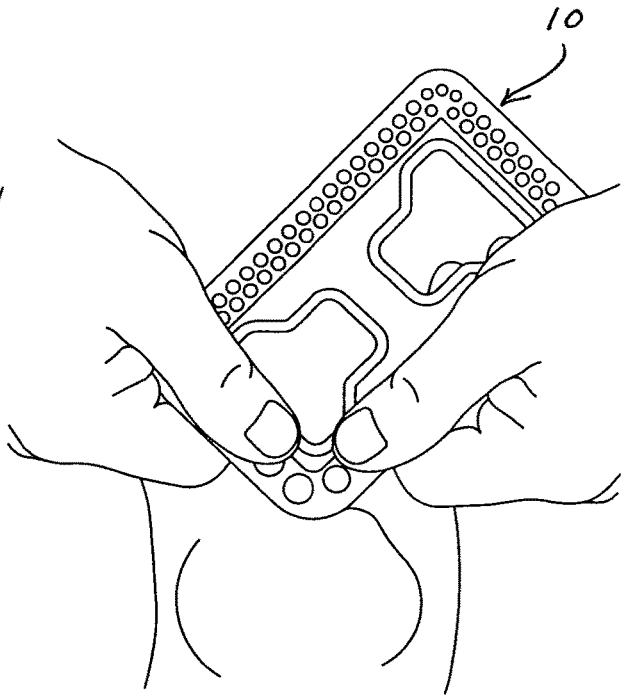
Figure 19:
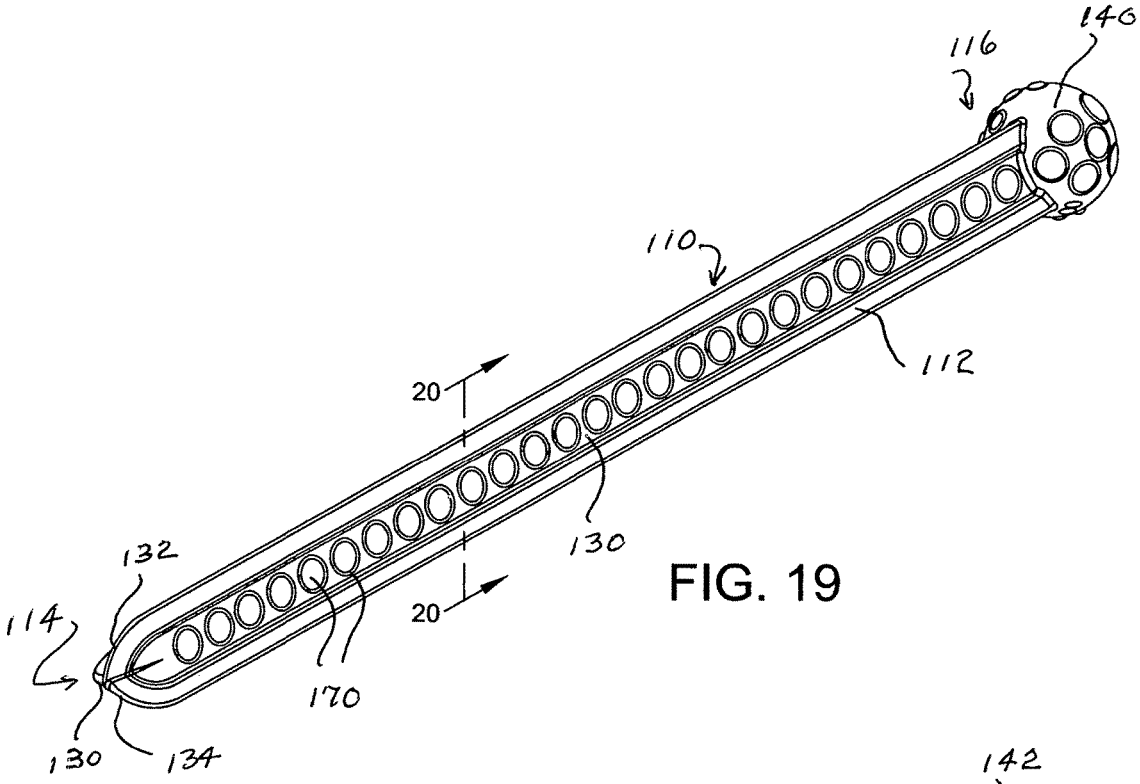
FIG. 19 is a front perspective view of another form of the invention.
Figure 20:
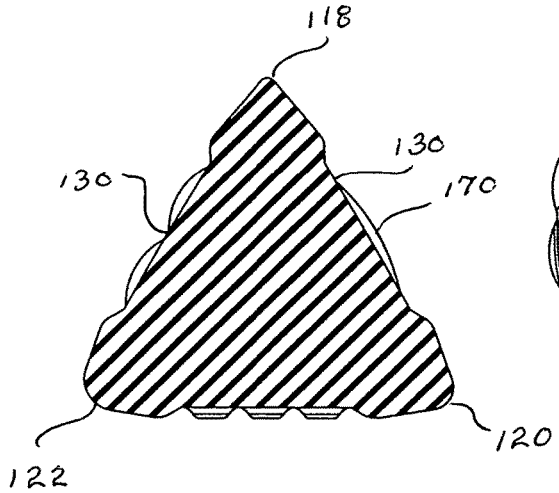
FIG. 20 is a sectional view along the line 20-20 of FIG. 19.
Figure 21:
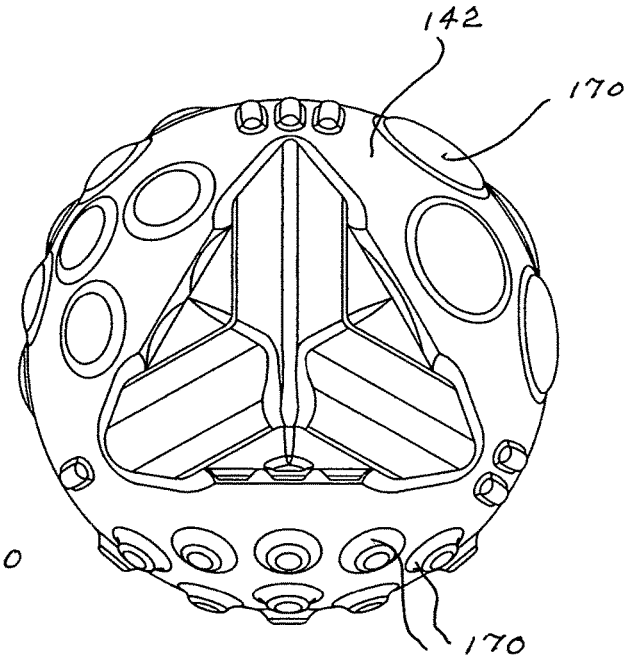
FIG. 21 is an enlarged end view taken from the left side of FIG. 19.

Referring to the drawings and particularly to FIGS. 1-5 thereof, the instrument or device 10 of the present invention is shown and comprises a generally rectangular generally flat body 12 having a top surface 14 and a bottom surface 16. The body 12 is preferably of a greater longitudinal extent 18 than its lateral extent 20 and defines peripheral treatment edges including upper and lower treatment edges 24 and 26 respectively as well as side treatment edges 28 and 30 that, in turn, connect to the upper and lower treatment edges. The connection between the side treatment edges and the upper and lower treatment edges may also have varying degrees of curvature.

The body 12 may further include a pair of openings or cutouts 36 having peripheral portions 38 extending therethrough that form the preferable means by which the device 10 is held and manipulated by the user. The cutouts 36 depicted are in a keyhole configuration but may assume other configurations. Preferably, the cutouts 36 are longitudinally oriented with respect to the body 12, that is, the longer dimensional extent of the openings is disposed from side to side as shown. In addition, those portions 38 of the cutouts 36 which are of lesser height or extent in the lateral direction as shown are disposed in proximal relationship to each other and separated from each other by a laterally extending bar 42 which, in turn, serves to stiffen the body 12 from over flexing along the body's longitudinal extent or axis but permits a desired greater amount of bending or flexibility about the lateral axis (see FIG. 5 in particular). The bar 42 further serves to enable the user's fingers and thumb to firmly engage and grasp the device 10 in a greater number of ways so as to perform a greater number of massaging modes to the patient (see FIGS. 6-18 in particular).

The bar 42 as well as the portions of the top and bottom body surfaces 14, 16 which are between the peripheral portions 38 of the cutouts 36 and the top, bottom and side treatment edges 24, 26 and 28 and 30 respectively serve to delineate user finger and thumb rest or contact areas 60. Positioned between these contact areas 60 that are preferably flat and the treatment edges 24, 26 and 28 are a series of discrete nubs 70 upwardly protruding therefrom and preferably arranged in rows and lanes depending on the size and upward extent of such nubs 70. The nubs 70 are preferably circular and upwardly project from the body surfaces 14, 16 and terminate in dome-like tops 71 which are adapted to, in effect, penetrate into the top layers of the patient's skin so that massaging movements of the device will move the skin and at least some of the underlying areas thereof back and forth in the intended manner. Smaller diameter nubs which are of the same height as larger diameter nubs will exhibit more angular (sharper) sidewalls and thus would be used when a higher (more aggressive) grasp of underlying skin tissue is desired. Nubs of the same size are preferably grouped together.

The device 10 of the present invention is a flexible instrument used for soft tissue mobilization and is preferably constructed from polyurethane rubber. The device can be constructed-from varying durometer material depending upon the desired flexibility of the unit and how the user wishes the instrument 10 to react on the soft tissue being treated. There are also many other materials that the device could be constructed from in addition to Polyurethane. Because the instrument or device 10 is flexible and not rigid, the instrument 10 of the present invention can be easily bent and shaped to conform to a variety of different body contours. The thickness of the device may vary depending on the treatment goals and the body part being treated. The instrument depicted may have a thickness of ⅜ inch. The instruments range in durometer on the A scales from 60-95. The higher the durometer, the harder, more rigid and less flexible the material. The softer the durometer the more flexible the device or instrument 10 and the easier it is to shape the device 10 to conform to the body part being treated. The higher the durometer the more rigid the instrument will be and the easier it will be to access deeper levels of soft tissue. The softness of the urethane material allows the user to mobilize soft tissue around and directly over superficial boney areas without discomfort. The softer durometer material can also be used to form more easily to the contour of the body part being treated and to provide better grip and traction on the soft tissue. The device 10 of the present invention will bend slightly over these rigid boney areas of the body. This is too painful to attempt with stainless steel and other rigid instruments.

The instrument or device 10 may be 6 inches long and 3.5 inches high, but this may change depending on the goals of treatment and body part being treated. The device incorporates a number of different treatment edges. The edges may be labeled on either or both of the instrument's sides. The edges may vary from dull to sharp. At least one side of the instrument may incorporate nubs 70. The single row of larger nubs 70 is the dullest for beginning treatment and preferably corresponds to the dullest treatment edges. The double row of nubs 70 is slightly higher in profile for more aggressive treatment. The number of edges can vary from a single edge to four or more edges depending on the size constraints of the device. The perimeter edge design may also vary depending on the desired level of penetration into the soft tissue and the number of edges the device contains. Each corner of the device of the present invention has a radius that also forms a treatment edge.

Figure 22:
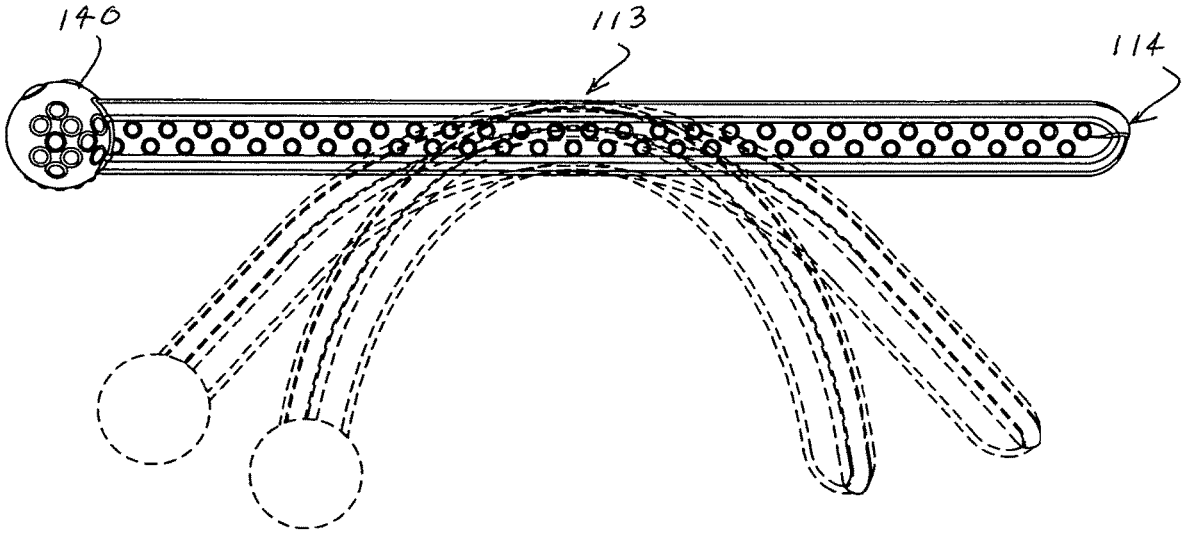
FIG. 22 is a front elevational view of the alternate instrument embodiment of FIG. 19 illustrating in broken lines the manner in which the instrument may be bent to various shapes to better match the profile of the body part to be manipulated.

Referring to the drawings and more particularly to FIGS. 19-22, another form of the instrument or device 110 of the present invention is depicted and comprises an elongated body 112 having first and second terminal ends 114 and 116 respectively. The body 112 is preferably formed of a polyurethane elastomeric rubber material having a durometer from 60 to 100 A so as to provide a somewhat elastic relatively high frictional surface contact with the skin surface of the patient as the body 112 is moved along and/or back and forth across the skin surface coupled with a downward inward pressure thereon in the intended manner. A suitable material for construction of the body 112 is Vibrathane® 6060 available from Polyurethane Products Corporation under the trade name Die-Thane. Such material enables the rod-like body 112 to be bent by the clinician into a wide variety of generally U-shaped bends as shown by FIG. 22 to shape the central area 113 of the body 112 to conform to the surface of the particular body part of the patient being treated.

The body 112 includes at least one and preferable three treatment edges 118, 120 and 122 extending upwardly in profile from the body and extending longitudinally therealong between the ends 114 and 116. These edges 118, 120 and 122 are of varied cross-sectional configurations to, in effect, provide the clinician with a wide range of treatment tools to affect various treatment procedures. That is, the aforementioned edges vary from a dull rounded configuration to a second more pointed edge. The treatment edges 118, 120 and 122 are preferably circumferentially disposed about the body 112 and are separated from each other in equal areas of approximately 120 degrees. Between each of the treatment edges is a relatively flat area or surface 130 which, in turn, is provided with upstanding nubs 170 similar in configuration and extent to the nubs 70 described with reference to the invention shown in FIGS. 1-5 of the drawings. Preferably, one such surface 130 includes a single row of large nubs 170 while another of the surfaces 130 includes two parallel rows of medium nubs 170 and still another surface 130 includes three rows of smaller nubs 170.

The edges 118, 120 and 122 each merge into rounded terminal end edge portions 130, 132 and 134 to cooperatively form a smooth rounded configuration to the first end 114 that along with the terminal edge end portions 130, 132 and 134 may be utilized by the clinician to reach areas of the patient's body not readily accessible to the central area 113 of the body 112. The opposite second end 116 is preferably provided with a cylindrical or rounded knob or disc 140 having an outer rounded treatment surface 142. Such surface 142 is provided with nubs 170 grouped according to their size and spaced around such surface 142 such that the user may access smaller body areas of the patient.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A massage instrument adapted to be held by a user comprising a generally rectangular body having opposed generally flat front and rear surfaces and continuous flexible peripheral edges including a top edge, a bottom edge and side connecting edges, said continuous flexible peripheral edges having varying cross-sectional configurations from relatively sharp to relatively rounded so as to present a plurality of treatment edges of differing flexibility for the mobilization and massage of the soft tissue of the human body when the user angularly engages one of said treatment edges with a soft tissue area of the human body, said generally rectangular body including a plurality of tissue engaging nubs outwardly extending from at least one of said front and rear surfaces, said nubs arranged in one or more patterns that extend around the periphery of said body and positioned laterally inwardly from said top and bottom edges thereof and longitudinally inwardly from said side edges thereof, said nubs presenting a variety of treatment surfaces for the mobilization and massage of the soft tissue of the human body when the user presses said body and thus said nubs into the soft tissue being manipulated or massaged.

2. The instrument of claim 1, said continuous flexible peripheral edges further defining curved corner treatment edges connecting said top and bottom edges to said side connecting edges.

3. The instrument of claim 1, said body formed of an elastomeric material such that said flat surfaces can be upwardly and downwardly bent by the user such that said bends at least partially conform to the human body part being manipulated by the user.

4. The instrument of claim 2 said generally rectangular body formed of an elastomeric material such that said flat surfaces can be upwardly and downwardly bent by the user such that said bends at least partially conform to the human body part being manipulated by the user.

5. A massage instrument adapted to be held by a user comprising a generally rectangular body having opposed generally flat front and rear surfaces and flexible peripheral edges including a top edge, a bottom edge and side connecting edges, said flexible peripheral edges presenting a plurality of treatment edges for the mobilization and massage of the soft tissue of the human body when the user angularly engages one of said treatment edges with a soft tissue area of the human body, said generally rectangular body having a pair of longitudinally spaced openings having opposed ends and serving as finger grips whereby the instrument may be grasped by both the right and left hands of the user, said openings positioned in two opposites of a centerline of the instrument, said generally rectangular body formed of an elastomeric material such that said sides can be upwardly and downwardly bent by the user such that said bends at least partially conform to the human body part being manipulated by the user, said openings separated by a laterally disposed material bridge extending from the top edge to said bottom edge whereby said bridge functions as a stiffening member to resist bending along the longitudinal centerline of the body but permits limited bending around the lateral centerline thereof.

6. The instrument of claim 5, said openings each having a narrower lateral extent at those ends thereof that are proximate to each other, said bridge, said proximate ends and said top and bottom edges compositely forming finger rest areas for the user.

7. A massage instrument adapted to be held by a user comprising a generally flat body having opposed generally flat front and rear surfaces, said body further including flexible peripheral edges including a top edge, a bottom edge and side connecting edges, said generally rectangular body including a plurality of tissue engaging nubs outwardly extending from at least one of said front and rear surfaces, said nubs arranged in one or more patterns that extend around the periphery of said body and positioned laterally inwardly from said top and bottom edges thereof and longitudinally inwardly from said flexible peripheral edges thereof, said nubs presenting a variety of treatment surfaces for the mobilization and massage of the soft tissue of the human body when the user presses said body and thus said nubs into the soft tissue being manipulated or massaged, said generally rectangular body having a pair of longitudinally spaced openings having opposed ends and serving as finger grips whereby the instrument may be grasped by both the right and left hands of the user, said openings positioned on two opposites of a centerline of the instrument, said openings each having a narrower lateral extent at those ends thereof that are proximate to each other so as to form a laterally extending material bridge extending from the top edge to the bottom edge, said bridge and said proximate ends compositely forming finger rest areas for the user.

8. The instrument of claim 7, said nubs positioned outwardly of said finger rest areas and inwardly of said top, bottom and side treatment edges.

9. The instrument of claim 8, said nubs of rounded dome configuration and grouped in rows and lanes of similarly sized nubs.

* * * * *